US010799890B2

(12) United States Patent
Li

(10) Patent No.: US 10,799,890 B2
(45) Date of Patent: Oct. 13, 2020

(54) DIFFERENTIAL FORCE ROTARY SPRINKLER

(71) Applicant: Chunlin Li, Siping (CN)

(72) Inventor: Chunlin Li, Siping (CN)

( * ) Notice: Subject to any disclaimer, the term of this patent is extended or adjusted under 35 U.S.C. 154(b) by 27 days.

(21) Appl. No.: 16/231,888

(22) Filed: Dec. 24, 2018

(65) Prior Publication Data

US 2019/0126298 A1 May 2, 2019

Related U.S. Application Data

(63) Continuation of application No. PCT/CN2017/087422, filed on Jun. 7, 2017.

(30) Foreign Application Priority Data

Jun. 24, 2016 (CN) ..... 2016 1 0467399
Jun. 24, 2016 (CN) ..... 2016 2 0635005 U

(51) Int. Cl.
*B05B 3/00* (2006.01)
*B05B 3/06* (2006.01)

(52) U.S. Cl.
CPC ..... *B05B 3/06* (2013.01)

(58) Field of Classification Search
CPC ..... B05B 3/02; B05B 3/025; B05B 3/06
USPC ..... 239/380, 381; 285/121.5
See application file for complete search history.

(56) References Cited

U.S. PATENT DOCUMENTS 130,798 A * 8/1872 Finley ..... B05B 3/06 239/245
137,175 A * 3/1873 Brusie ..... B05B 3/06 239/246
1,831,956 A * 11/1931 Harrington ..... E21B 33/085 277/326
2,045,634 A * 6/1936 Cram ..... D21F 5/10 285/121.5

(Continued)

FOREIGN PATENT DOCUMENTS

CN 202667035 U 1/2013
CN 103736609 A 4/2014

(Continued)

OTHER PUBLICATIONS

The International Search Report of corresponding International PCT Application No. PCT/CN2017/087422, dated Sep. 13, 2017.

*Primary Examiner* — Viet Le
(74) *Attorney, Agent, or Firm* — J.C. Patents

(57) ABSTRACT

A differential force rotary sprinkler comprises: a V-shaped rotary arm (1) having an arm body (11); a nozzle (2); a dust-resistant sealing cap (3) fixed and connected to the arm body (11); an upper oil seal (4) disposed at a lower end of an inner wall of the dust-resistant sealing cap (3); an upper bearing bush (5); a bearing housing (6); a lower bearing bush (7); a lower oil seal (8); a position-limiting screw nut (9); and a sealing O-ring (10). After the position-limiting screw nut (9) has been tightened, an axial gap of 0.5-1.5 mm is left between the position-limiting screw nut (9) and the lower bearing bush (7). An outer arm of the position-limiting screw nut (9) and the lower oil seal (8) realize a sealed smooth surface. The sprinkler realizes uniform spray of water and can be assembled and disassembled conveniently.

5 Claims, 5 Drawing Sheets

(56) References Cited

U.S. PATENT DOCUMENTS 2,412,287 A * 12/1946 Phillips ..... B65H 75/4478 285/121.5
2,424,969 A * 8/1947 Carpenter ..... F26B 13/183 285/121.5
2,700,576 A * 1/1955 Salsas-Serra ..... F24F 6/06 239/222.11
2,717,166 A * 9/1955 Hedden ..... F16L 27/087 285/121.5
2,759,777 A * 8/1956 Anderson ..... F16C 33/78 384/487
6,869,029 B2 * 3/2005 Ochoa, Sr. ..... A47L 15/508 134/176
7,568,635 B2 * 8/2009 Micheli ..... B05B 3/1014 239/240
9,789,498 B2 * 10/2017 Fu ..... B60S 3/044
2003/0075618 A1 * 4/2003 Shimazu ..... B05B 7/201 239/381
2003/0178505 A1 * 9/2003 Binder ..... B05B 1/1645 239/225.1
2004/0124266 A1 * 7/2004 Pinch ..... B05B 3/005 239/380
2004/0217202 A1 * 11/2004 Hynes ..... B05B 1/02 239/380
2006/0273194 A1 * 12/2006 Kapich ..... B05B 3/0427 239/214.11
2012/0104118 A1 * 5/2012 Wang ..... B05B 1/083 239/380
2012/0263551 A1 * 10/2012 Ura ..... F16L 39/04 409/135
2013/0008979 A1 * 1/2013 Lange ..... B05B 3/0427 239/380

FOREIGN PATENT DOCUMENTS

CN 104324823 A 2/2015
CN 205217220 U 5/2016
EP 0 901 832 A2 3/1999
WO WO 2014/196343 A1 5/2014

* cited by examiner

DIFFERENTIAL FORCE ROTARY SPRINKLER

CROSS-REFERENCE TO RELATED APPLICATIONS

This application is a continuation of International Application No. PCT/CN2017/087422, filed on Jun. 7, 2017, which claims the priority benefit of China Patent Application No. 201610467399.3, filed on Jun. 24, 2016 and China Patent Application No. 201620635005.6, filed on Jun. 24, 2016. The contents of the above identified applications are incorporated herein by reference in their entireties.

TECHNICAL FIELD

The invention relates to a sprinkling device and, in particular, to a differential force rotary sprinkler, which can be used for irrigation, such as farmlands, gardens, landscapes, fruits and vegetables, flowers and the like.

BACKGROUND

At present, there are broadly two types of rotary sprinklers available on the market, wherein the first type is rocker arm rotary sprinkler (rocker arm sprinkler for short) designed on mechanical principle, and the second type is jet rotary sprinkler (jet sprinkler for short) designed on fluid mechanics principle. When these types of sprinklers are in use, it is found that they have defects such as uneven spraying, unstable spray frame that is highly susceptible to tip-over, unstable rotation at an uneven speed, inability to support large-scale and large-area of irrigation, poor sealing, and short service life. In order to overcome the above defects, the applicant has proposed a prior application No. 201410076494.1, entitled "reflective rotary sprinkler". Although the reflective rotary sprinkler overcomes the above defects to some extent, the applicant found that there is still some defects in use, in particular: (1) since the dust-resistant cap and the shaft tube are sleeved over the bearing housing via a threaded connection, which connection does not provide a very tight sealing, the assembly is susceptible to water ingression when used, and since water ingression into the bearing housing can deteriorate the lubricating oil, the oil needs to be replaced frequently, which brings many inconveniences; (2) the friction between the shaft tube and the bearing bush is hard friction, making the rotation not uneven, and thus it is impossible to realize low speed during rotation; (3) the existing disassembling method is implemented by screwing off a sealing screw plug, which is relatively easy, but assembling is very inconvenient; and (4) the existing sprinkler does not provide a very even water spraying, and it is often lack of water in the middle region thereof when spraying.

A prior application No. 201610467399.3 entitled "DIFFERENTIAL FORCE ROTARY SPRINKLER" solved the above-mentioned problems in prior art. However, in practical use, the applicant found that that there are still the following deficiencies, in particular: (1) after long term use, the rotating friction between the sealing cap and the position-limiting screw nut can lead to oil shortage, which causes the rotation to stop, and thus it needs to stop the operation of the differential force rotary sprinkler, and replenish the oil in the sealing cap, which is a laborious process and affects irrigation cycle; (2) after long term working between the first sealing rubber ring disposed on the inner wall of the dust-resistant cap and a lower portion of the arm body, the first sealing rubber ring is easily worn and thus needs to be replaced frequently, which is cumbersome and laborious, affecting irrigation; (3) the position-limiting screw nut is located at the middle of the arm body, the sealing cap needs to be unscrewed during disassembling, and thus assembling and disassembling are inconvenient; (4) since there is no lubricating oil supplement when a gap is opened in working state, the lubrication is not good, causing the rotational speed of the differential force rotary sprinkler to be too fast to reach a rotation speed less than one revolution every 5 minutes, failing to ensure the range and area of the spraying.

SUMMARY

An object of the present invention is to provide a differential force rotary sprinkler which is simple and reasonable in structure, does not need to replace lubricating oil frequently, has good sealing, and can achieve uniform low-speed rotation, uniform water spraying, water saving, and convenient assembling and disassembling.

The object of the present invention is achieved as such: the sprinkler includes: a V-shaped rotary arm, a nozzle, a dust-resistant sealing cap, an upper oil seal, an upper bearing bush, a bearing housing, a lower bearing bush, a lower oil seal, a position-limiting screw nut, and a sealing O-ring, wherein the nozzle is symmetrically disposed at two top ends of the V-shaped rotary arm, the dust-resistant sealing cap is fixed and connected to an arm body of the V-shaped rotary arm, the arm body has an annular position-limiting step, the annular position-limiting step is concealed inside the dust-resistant sealing cap, the upper oil seal is disposed at a lower end of an inner wall of the dust-resistant sealing cap, the upper bearing bush is mounted at an upper end of the bearing housing, the lower bearing bush and the lower oil seal are sequentially disposed in the middle position inside bearing housing from top to bottom, the upper bearing bush, the bearing housing, the lower bearing bush and the lower oil seal are assembled to constitute a bearing housing body, the bearing housing body is sleeved over the arm body of the V-shaped rotary arm, wherein the upper bearing bush engages with and is positioned by the annular position-limiting step, the position-limiting screw nut having the sealing O-ring inside thereof is sleeved over the arm body via a threaded connection and is located underside the bearing housing body, an axial gap of 0.5-1.5 mm is preserved between the position-limiting screw nut and the lower bearing bush after the position-limiting screw nut has been tightened, and an outer arm of the position-limiting screw nut and the lower oil seal realize a sealed smooth surface.

The nozzle is provided with a front spray hole and a back spray hole, wherein the front spray hole has a smaller diameter than that of the back spray hole, and there is an angle $\alpha$ of 90 to 120° between the front spray hole and the back spray hole.

The present invention has the following advantages and desirable effects:

1. In the present invention, the dust-resistant sealing cap and the rotary arm are integrated into one body via welding, and an upper oil seal is provided within the dust-resistant sealing cap, and when the bearing housing body has been mounted in place, the dust-resistant sealing cap, the arm body of the rotary arm and the upper oil seal form a first oil storage cavity, and the upper bearing bush, the bearing housing, the lower bearing bush and the arm body form a second oil storage cavity, and gaps in communication with the oil storage cavities are provided between the upper bearing bush and the lower bearing bush and the arm body of the rotary arm. Thereby, a continuous supply of lubricating oil can be provided, with advantages of good sealing, uniform rotation and long service life.

2. In the present invention, an angle between the back spray hole and the front spray hole on the nozzle is set to 90 to 120°, which is a more reasonable angle. Regardless of which hole of the back spray hole and the front spray hole being raised, the higher hole always sprays a closer distance while the lower hole always sprays a further distance, this allows an uniform spray. Thus, there is more uniform water spray, leaving no blind spot.

3. Since the gap between the upper bearing bush and the annular position-limiting step is opened in working state, and position of the oil storage cavity is high, allowing the lubricating grease to automatically fill the gap to replenish the lubricating oil and offering good lubrication, the differential force rotating sprinkler can reach a rotating speed of as low as less than one revolution per 5 minutes, with a beset effect of one revolution per 20 minutes, which ensures an range and area of the spray.

Figure 1:
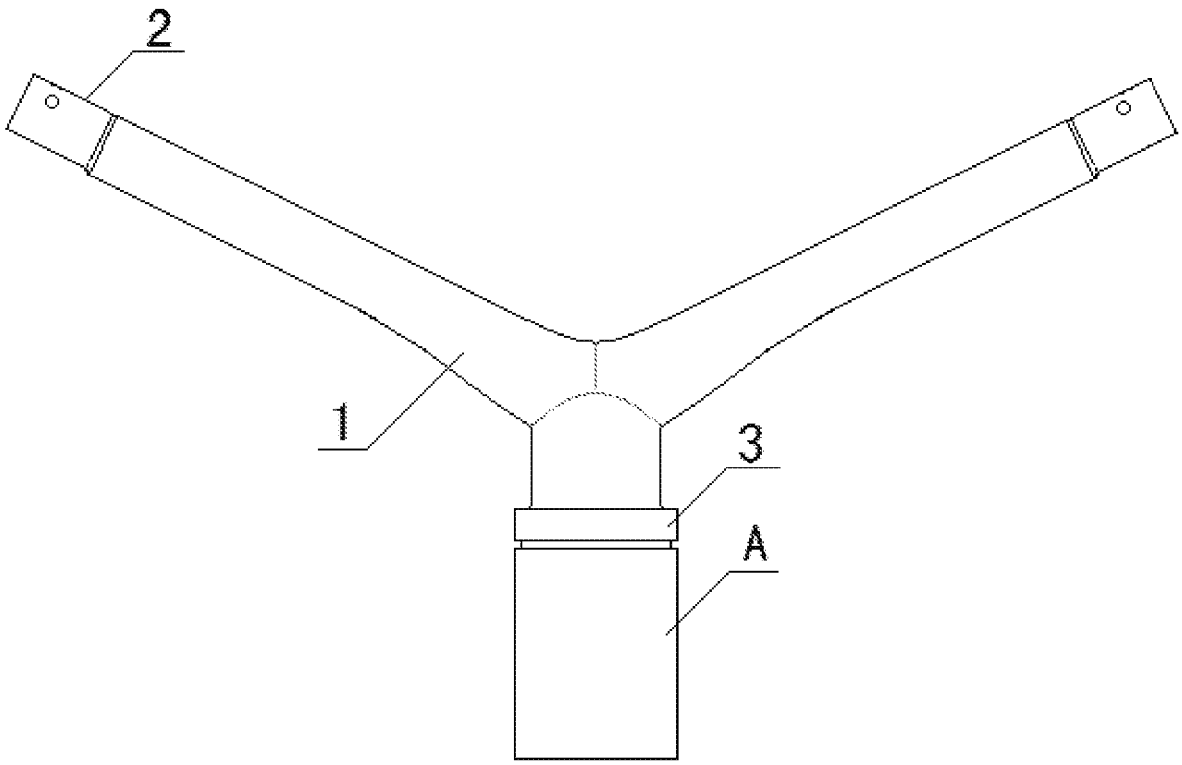
FIG. 1 is a schematic view of an overall structure of the present invention.

Reference numerals in the above drawings: 1. V-shaped rotary arm; 2. nozzle; 3. dust-resistant sealing cap; 4. upper oil seal; 5. upper bearing bush; 6. bearing housing; 7. lower bearing bush; 8. lower oil seal; 9. position-limiting screw nut; 10. sealing O-ring; 11. arm body; 12. annular position-limiting step; 13 front spray hole; 14. rear spray hole; 15. first oil storage cavity; 16. second oil storage cavity 16.

DETAILED DESCRIPTION OF THE EMBODIMENTS

Figure 2:
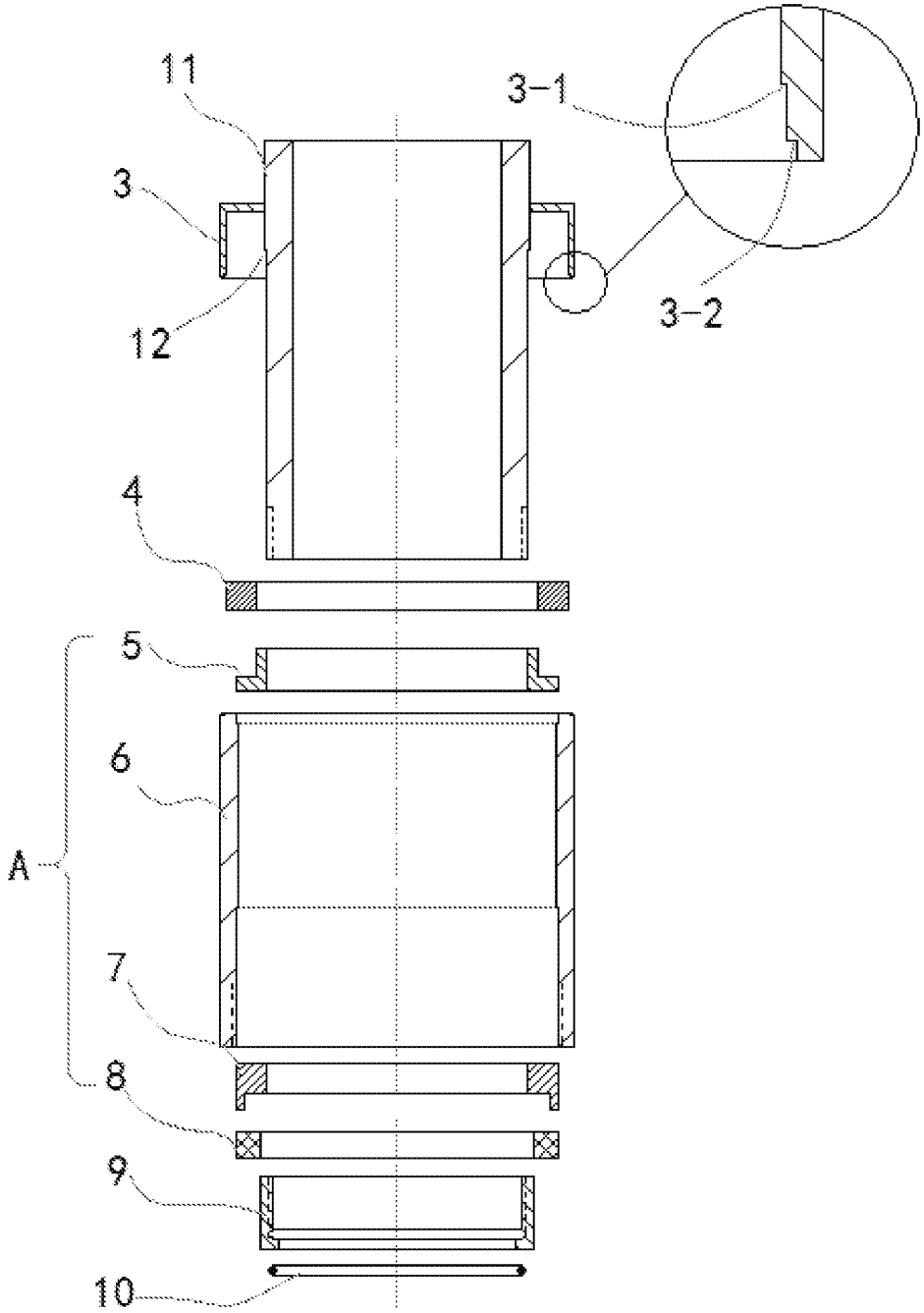
FIG. 2 is an exploded view of an assembly in FIG. 1 of the present invention.
Figure 3:
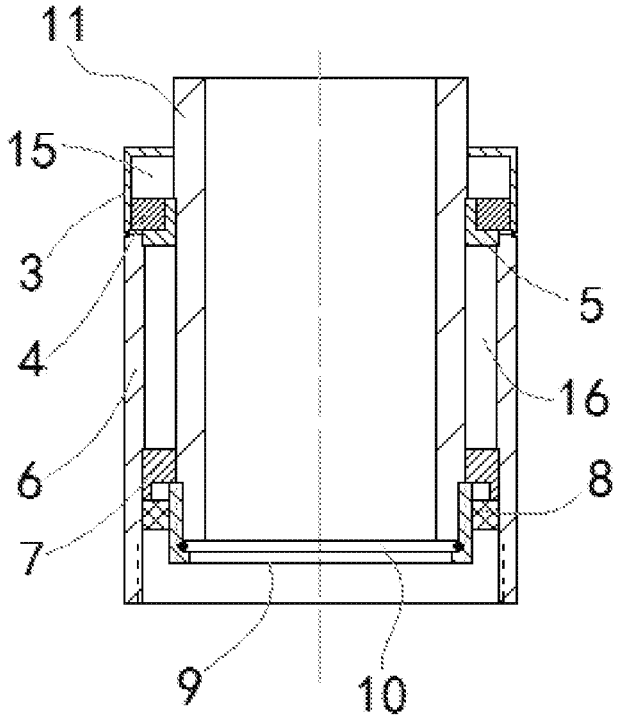
FIG. 3 is an assembled view of components in FIG. 2 of the present invention.
Figure 4:
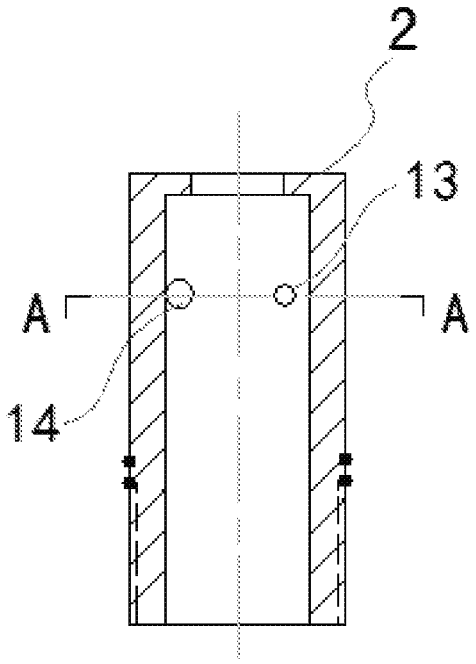
FIG. 4 is a cross-sectional view of the structure of a sprinkler of the present invention.
Figure 5:
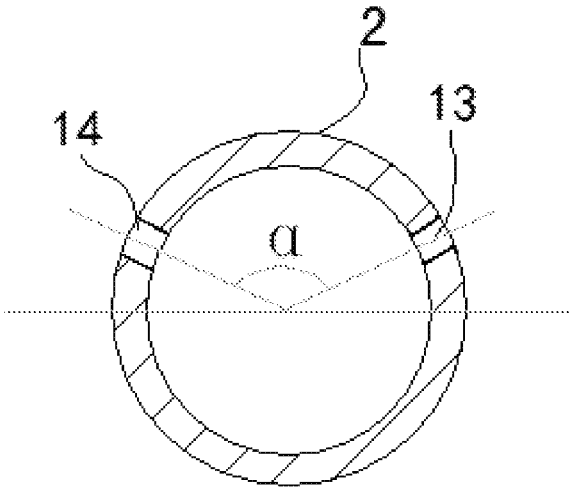
FIG. 5 is a cross-sectional view taken along line A-A of FIG. 4 of the present invention.

As shown in FIGS. 1 and 2, the sprinkler includes: a V-shaped rotary arm (1); a nozzle (2); a dust-resistant sealing cap (3); an upper oil seal (4); an upper bearing bush (5); a bearing housing (6); a lower bearing bush (7); a lower oil seal (8); a position-limiting screw nut (9); and a sealing O-ring (10), wherein the nozzle is symmetrically disposed at two top ends of the V-shaped rotary arm, the dust-resistant sealing cap (3) is fixed and connected to an arm body (11) of the V-shaped rotary arm (1), the arm body (11) has an annular position-limiting step (12), the annular position-limiting step (12) is concealed inside the dust-resistant sealing cap (3), the upper oil seal (4) is disposed at a lower end of an inner wall of the dust-resistant sealing cap (3), the upper bearing bush (5) is mounted at an upper end of the bearing housing (6), the lower bearing bush (7) and the lower oil seal (8) are sequentially disposed in the middle position inside bearing housing (6) from top to bottom, the upper bearing bush (5), the bearing housing (6), the lower bearing bush (7) and the lower oil seal (8) are assembled to constitute a bearing housing body, the main body of the bearing housing (6) is sleeved over the arm body (11) of the V-shaped rotary arm (1), wherein the upper bearing bush (5) engages with and is positioned by the annular position-limiting step (12), the position-limiting screw nut (9) having the sealing O-ring (10) inside thereof is sleeved over the arm body (11) via a threaded connection and is located underside the bearing housing body, an axial gap of 0.5-1.5 mm is preserved between the position-limiting screw nut (9) and the lower bearing bush (7) after the position-limiting screw nut (9) has been tightened, and an outer arm of the position-limiting screw nut (9) and the lower oil seal (8) realize a sealed smooth surface.

The inner wall of the dust-resistant sealing cap (3) has two steps, wherein an upper step (3-1) provides an engaging platform for the upper oil seal (4), and a lower step (3-2) provides a sealing platform for the dust-resistant sealing cap (3) and the bearing housing (6).

The nozzle (2) is provided with a front spray hole (13) and a back spray hole (14), wherein the front spray hole (13) has a smaller diameter than that of the back spray hole (14), and there is an angle $\alpha$ of 90 to 120° between the front spray hole (13) and the back spray hole (14).

The dust-resistant sealing cap (3), the upper oil seal (4) and the arm body (11) define a first oil storage cavity (15); and the upper bearing bush (5), the bearing housing (6), the lower bearing bush (7) and the arm body (11) define a second oil storage cavity (16).

A gap of at least 0.15 mm in a radial direction is provided between the upper bearing bush (5) and the lower bearing bush (7) and the arm body (11) to facilitate lubrication for rotation.

Operating Process:

When in use, a water inlet pipeline is connected to the internal thread beneath the bearing housing. Since two spray holes, the front spray hole (13) and the back spray hole (14) disposed on the nozzles (2) at the top end of the V-shaped rotary arm (1) are in opposite directions, when a water pump pressurizes water and send it via a pipeline to the sprinkler, the water flow will be sprayed from the front spray hole (13) and the back spray hole (14) on the nozzle (2), where the water sprayed from the front spray hole (13) will fall into a range near the sprinkler, while the water sprayed from the back spray hole (14) covers a further range. Functions of the back spray hole (14) are not only to spray the water to a distant place, but also to generate a force for rotation of the sprinkler.

Operating Principle:

When a force driving the sprinkler to rotate is F, and a frictional resistance is $F_1$, a driving force for the front spray hole is $F_2$, a driving force for the back spray hole (14) is $F_3$, then the force driving the sprinkler to rotate is $F=F_3-F_1-F_2$. Since $F_1$ is constant while $F_2$ and $F_3$ are changeable via adjustment. When the sprinkler is such manufactured (leaves factory) that when the front spray hole and the back spray hole are all at a 30° horizontal elevation angle, $F_3$ is greater than $F_1$ plus $F_2$. When the sprinkler is working, the sprinkler is in a state of a constant medium rotation speed. When the rotation speed needs to be increased, the angle of the back spray hole can be adjusted downwards, so that its horizontal elevation angle is lower than 30°, and meanwhile the horizontal elevation angle of the front spray hole will be greater than 30°. Since a thrust generated by reverse thrust of air on rotation of the sprinkler is that the smaller the angle is, the larger the thrust is and vice versa, the larger the angle is, the smaller the thrust is. Therefore, when the back spray hole is adjusted to a horizontal elevation angle of 0°, the front spray hole reaches its maximum horizontal elevation angle of 60°. At this time, $F_3$ is the largest, the driving force for the front spray hole $F_2$ is the smallest, the sprinkler rotates fastest, and F has a maximum value. Conversely, when lower rotation speed is required, the front spray hole is adjusted downward. When the front spray hole is adjusted to a horizontal elevation angle of 0°, the horizontal elevation angle of the back spray hole will be 60°. At this time, the difference $F_3-F_1-F_2$ is the smallest, and the force F driving the sprinkler to rotate is minimized, then the sprinkler is in the state of the lowest speed rotation.

When the sprinkler is not working and in a static state, the space inside the bearing housing (6) and the oil storage cavity in the dust-resistant sealing cap (3) are all filled with grease. Now, an upper end surface of the upper bearing bush (5) is loaded in close contact due to gravity, and the gap between the lower bearing bush (7) and the position-limiting screw nut (9) opens, allowing the grease to automatically flow into the axial gap of 0.5-1.5 mm preserved between the lower bearing bush (7) and the position-limiting screw nut (9).

At the beginning of the work, the pressurized water is pumped by a water pump into a water feeding pipe and then is ejected out of the nozzle (2). Since the back thrust generated by the water sprayed from the back spray hole (14) is greater than the front thrust generated by the water sprayed from the front spray hole (13), the sprinkler rotates by the back thrust while the water pressure rapidly reaches a peak. Since the pressurized water imparts an upward thrust on the sprinkler, the gap between the upper bearing bush (5) and the annular position-limiting step (12) is opened. Since the oil storage cavity is at a high position, the lubricating grease may automatically fill the gap. Now, the gap between the lower bearing bush (7) and the position-limiting screw nut (9) is closed. When the irrigation work is completed, the water pressure disappears, and the force generated by self-weight of the upper bearing bush (5) causes its gap to close, and the gap between the lower bearing bush (7) and the position-limiting screw nut (9) is to open, allowing the grease to automatically fill the gap between the lower bearing bush (7) and the position-limiting screw nut (9). This cycle is repeated, realizing lubrication and maintenance without need to disassemble the sprinkler, while ensuring a more even and reliable rotation over the design of prior application.

What is claimed is:

1. A differential force rotary sprinkler, comprising: a V-shaped rotary arm (1); a nozzle (2); a dust-resistant sealing cap (3); an upper oil seal (4); an upper bearing bush (5); a bearing housing (6); a lower bearing bush (7); a lower oil seal (8); a position-limiting screw nut (9); and a sealing O-ring (10), wherein the nozzle is symmetrically disposed at two top ends of the V-shaped rotary arm, the dust-resistant sealing cap (3) is fixed and connected to an arm body (11) of the V-shaped rotary arm (1), the arm body (11) has an annular position-limiting step (12), the annular position-limiting step (12) is concealed inside the dust-resistant sealing cap (3), the upper oil seal (4) is disposed at a lower end of an inner wall of the dust-resistant sealing cap (3), the upper bearing bush (5) is mounted at an upper end of the bearing housing (6), the lower bearing bush (7) and the lower oil seal (8) are sequentially disposed in the middle position inside bearing housing (6) from top to bottom, the upper bearing bush (5), the bearing housing (6), the lower bearing bush (7) and the lower oil seal (8) are assembled to constitute a bearing housing body (A), the bearing housing body (A) is sleeved over the arm body (11) of the V-shaped rotary arm (1), wherein the upper bearing bush (5) engages with and is positioned by the annular position-limiting step (12), the position-limiting screw nut (9) having the sealing O-ring (10) inside thereof is sleeved over the arm body (11) via a threaded connection and is located underside the bearing housing body (A), an axial gap of 0.5-1.5 mm is preserved between the position-limiting screw nut (9) and the lower bearing bush (7) after the position-limiting screw nut (9) has been tightened, and an outer arm of the position-limiting screw nut (9) and the lower oil seal (8) realize a sealed smooth surface, wherein the dust-resistant sealing cap (3), the upper oil seal (4) and the arm body (11) define a first oil storage cavity (15).

2. The differential force rotary sprinkler according to claim 1, wherein the nozzle (2) is provided with a front spray hole (13) and a back spray hole (14), where the front spray hole (13) has a smaller diameter than that of the back spray hole (14), and there is an angle $\alpha$ of 90 to 120° between the front spray hole (13) and the back spray hole (14).

3. The differential force rotary sprinkler according to claim 1, wherein the upper bearing bush (5), the bearing housing (6), the lower bearing housing (7) and the arm body (11) define a second oil storage cavity (16).

4. The differential force rotary sprinkler according to claim 1, wherein a gap of at least 0.15 mm in a radial direction is provided between the upper bearing bush (5) and the lower bearing bush (7) and the arm body (11) to facilitate lubrication for rotation.

5. The differential force rotary sprinkler according to claim 1, wherein the inner wall of the dust-resistant sealing cap (3) has two steps, wherein an upper step (3-1) provides an engaging platform for the upper oil seal (4), and a lower step (3-2) provides a sealing platform for the dust-resistant sealing cap (3) and the bearing housing (6).

* * * * *